US009936792B2

(12) United States Patent
Bruce

(10) Patent No.: US 9,936,792 B2
(45) Date of Patent: Apr. 10, 2018

(54) FACIAL LIFT

(71) Applicant: Craig Bruce, Encinitas, CA (US)

(72) Inventor: Craig Bruce, Encinitas, CA (US)

( * ) Notice: Subject to any disclaimer, the term of this patent is extended or adjusted under 35 U.S.C. 154(b) by 0 days.

(21) Appl. No.: 13/786,773

(22) Filed: Mar. 6, 2013

(65) Prior Publication Data

US 2013/0274787 A1 Oct. 17, 2013

Related U.S. Application Data

(63) Continuation of application No. 12/038,817, filed on Feb. 28, 2008, now abandoned.

(60) Provisional application No. 60/904,342, filed on Feb. 28, 2007.

(51) Int. Cl.
*A45D 44/22* (2006.01)

(52) U.S. Cl.
CPC ..... *A45D 44/22* (2013.01)

(58) Field of Classification Search
CPC ..... A45D 44/22
USPC ..... 606/204.15, 204.35, 201; 600/24, 600/237–239, 242; 128/859, 861–862, 128/848; 424/402, 404, 422–423, 435; 433/6, 7, 140; 482/10–11, 121, 124; 604/304; 623/17.17
See application file for complete search history.

(56) References Cited

U.S. PATENT DOCUMENTS

| | | | | |
|---|---|---|---|---|
| 2,061,550 | A | 11/1936 | Cavazza | |
| 2,431,521 | A | 11/1947 | Thiemann | |
| 2,568,197 | A | 9/1951 | Laffin | |
| 2,842,119 | A * | 7/1958 | Walton | 606/204.15 |
| 3,584,620 | A | 6/1971 | Hale | |
| 4,204,324 | A | 5/1980 | Köstner et al. | |
| 4,671,766 | A | 6/1987 | Norton | |
| 5,648,399 | A | 7/1997 | Friedman et al. | |
| 6,319,510 | B1 | 11/2001 | Yates | |
| 6,328,756 | B1 | 12/2001 | Amernick | |
| 6,652,275 | B2 | 11/2003 | Byers | |
| 6,830,590 | B1 | 12/2004 | Palahnuk et al. | |
| 2003/0138469 | A1 | 7/2003 | Koda et al. | |
| 2004/0194788 | A1 * | 10/2004 | Sweet | 128/858 |
| 2006/0008778 | A1 | 1/2006 | Rosenberg | |
| 2006/0172262 | A1 | 8/2006 | Bruce | |

(Continued)

FOREIGN PATENT DOCUMENTS

| | | |
|---|---|---|
| WO | WO 2004/056261 | 7/2004 |
| WO | WO 2006/030886 | 3/2006 |

OTHER PUBLICATIONS

U.S. Appl. No. 10/346,946, filed Jan. 17, 2003, Bruce.
U.S. Appl. No. 60/435,031, filed Dec. 19, 2002, Bruce.

*Primary Examiner* — Victor Nguyen
*Assistant Examiner* — Jonathan Hollm
(74) *Attorney, Agent, or Firm* — Baker & Hostetler LLP

(57) ABSTRACT

A facial lift device to be placed behind the lips and above the gums disposed alongside the buccal and facial surface of a living human maxilla or a human mandible no further than the most posterior tooth of one side to the most posterior tooth of the opposite side of said maxilla or mandible. The facial device embodies an outward lifting force when placed within the human mouth under the lips and alongside the anterior vestibule centered on the frenulum, such that when said facial lift device is forced behind the maxilla or mandible lips, the facial lift will forcibly lift out the dermal layer reducing and removing lower facial wrinkles within the perioral region.

17 Claims, 4 Drawing Sheets

(56) References Cited

U.S. PATENT DOCUMENTS

| | | | |
|---|---|---|---|
| 2008/0108020 | A1 | 5/2008 | Bruce |
| 2008/0275482 | A1 | 11/2008 | Bruce |
| 2010/0101587 | A1 | 4/2010 | Bruce |

* cited by examiner

FACIAL LIFT

CROSS REFERENCE TO RELATED APPLICATIONS

This application is a continuation of U.S. patent application Ser. No. 12/038,817, filed Feb. 28, 2008, which claims benefit of U.S. Provisional Patent Application No. 60/904,342, filed Feb. 28, 2007, the disclosures of which are hereby incorporated by reference in their entireties.

TECHNICAL FIELD

The invention relates generally to facial muscle manipulation. More specifically, the invention relates to a removable, flexible, lower facial lifting strip for reducing perioral wrinkles and aging lines from the dermal surface.

BACKGROUND

Since the dawn of civilization or since ancient Greece, people have searched for the 'fountain of youth' or a manner in which to turn back the hands of time and appear more youthful. As we age, lines and wrinkles become more numerous and prominent, particularly in the face causing additional and pronounced wrinkling of the mouth area. The area of skin surrounding ones mouth is highly susceptible to such wrinkles and aging lines due to the amount of fat cells present in the area and the continual growth of the nose and chin. As we age our teeth and gums also begin to recede, causing additional wrinkling to the mouth and lip area. Smoking, sun exposure and other environmental conditions also add to the aging and wrinkling of the face.

During the aging process, the nose continues to grow putting continual pressure on the upper lip causing ones teeth to show less and less during conversation and smiling. A need exists for a device capable of restoring the upper lip position allowing a more youthful appearance of the lower face addressing the upper and lower lip area. The prosthesis width or thickness will determine the amount of lip lift achieved.

As we age, our teeth and gums also begin to recede into the mouth. This movement of the teeth causes additional wrinkling around the mouth area as the skin folds sag without support, a condition which is exaggerated with the loss of skin elasticity, a condition that inevitably accompanies aging.

Ageing can also lead to a downward turn of the corners of the mouth (frown) that occurs when facial connective tissues and muscles (especially the Zygomaticus muscles, and the Levator Anguli Oris muscle) loosen with age.

A need exists to improve additional appearance conditions:

Lipstick Lines (peri-oral rhytids)

Bell's (or Facial Nerve) palsy

Long upper lips that obscure the upper teeth (i.e. can slightly elevate upper lip)

Hemi facial microsomia: This is when one half of the face doesn't grow as much as the other side. A need exists for a device that can be used to make the smile more symmetric.

The present invention provides a facial lift device which is easy and inexpensive to prepare, easy to install and remove, thus comfortably displacing the lips as to reduce facial wrinkles and ageing lines.

In recent years many attempts have been made to lift the perioral area, below the nose and under the nasal labial lines with removable, oral devices. Such devices have required cumbersome and expensive attachment to teeth, difficult and messy perioral adhesives, unreliable self molding techniques and even folding and building layers of tissue paper, all in an attempt to lift the lips and cheeks in order to push out aging lines and wrinkles.

The facial lift device of the invention differs from prior inventions as none of the above mentioned techniques are necessary. The facial lift device of the current invention embodies the use of simple and effective material memory; using the force generated by shaping a material whose memory works against the shape desired. By using a small flat flexible strip with high material memory, perioral dermal lifting and wrinkle removal can be easily accomplished by bending the strip to fit under a lip causing lift and force to occur at each end of the strip as it attempts to return to its original position.

The facial lift device of the invention differs from prior inventions relating to dentures or similar as the current invention does not cover the top of the gums. The current invention does not cover, protect, maintain or house teeth, prosthetic teeth or similar.

The facial lift device of the invention differs from prior inventions relating to orthodontics as the invention does not alter of affect the occlusion of the teeth. The current invention does not alter, adjust or attach to the teeth or gums in any way.

The facial lift device of the invention differs from prior inventions relating to gum atrophy or paradentosis as the facial lift device can be made from similar materials, however the purpose and/or function of the current invention is not to protect, cover or fit to exposed areas of the teeth beneath, above or below the gum line. The primary function of the device is to lift from the cavity within the mouth between the gums and the lips to dissipate facial wrinkles.

The facial lift device of the invention differs from prior inventions relating to cosmetic removable dental devices as the facial lift device is not fit through professional dental impressioning techniques or fastened within the mouth. The facial lift device of the invention also differs from prior cosmetic inventions as the facial lift is worn by living people and not used for facial lifting for casket display purposes. The prosthetic device is also a one piece homogenous mold of a consistent material. Unlike some facial cosmetic devices that fit between the cheek and gum without clasps or connections from right to left sides.

The facial lift device of the invention differs from prior inventions relating to cosmetic removable dental devices which contain teeth or simulated teeth as the neuromuscular prosthetic does not contain teeth, simulated or otherwise and do not attach to the teeth anywhere other than the last molar on either or both sides.

Byers U.S. Pat. No. 6,652,275:

The current invention overcomes the deficiencies of Byers device as Byers device attempts to lift perioral areas of skin by static displacement or fill instead of dynamic lift. Byers also requires the user to wear two devices of a smaller nature, thereby increasing lo the choking hazard and decreasing symmetrical lift. Byers also requires heat and pressure molding for a proper fit. The current invention does not require any molding or heating as the device is designed with a universal fit and the lift is accomplished through outer resistance apposed to Byers static displacement.

Amernick U.S. Pat. No. 6,328,756:

The Facial Lift of the present device overcomes the deficiencies of Amernick's device as the current device does not require layers of materials or folding of such. Furthermore, and similar to Byers device, Amernick's device attempts to lift the facial skin and lip area through displacement unlike the dynamic lift method of the current device. Even further, Amernick's device attempts to lift the facial skin by using an equal amount of fill or thickness across the frenulum area which is ineffective and painful for the user. Unlike Amernick's device, the current invention only uses material of high memory. Amernick attempts to use tissue and paper based materials which do not embody memory of any type.

Palahnuk U.S. Pat. No. 6,830,590

Pauluhnuk's device is similar in nature to Amernick's as it attempts to lift the lip and skin area through even fill or displacement across the anterior of the perioral region. Similar to Amernick's device, this is an inferior way to lift the anterior perioral region as the frenulum tissue restricts lift near the incisors. Attempting to lift this area through displacement turns the lip under. The current device overcomes this problem task by dynamically lifting the perioral area only near the canines while leaving the anterior most area near the frenulum alone. As our device embodies an outward force or material memory when bent around the anterior gum line, the lift is generated only right and left of the incisors and frenulum.

The disadvantages described above are overcome and other advantages are achieved in a facial lift device. The facial lift includes a flexible dynamic lifting component which rest under the upper or lower gums against the under side of the lips forcing the muscle to rest in a non wrinkle producing position. This skin lift or outward force restrains the low muscle from returning to its previous position where the wrinkles occur and pushes outward to reduce visible facial lines.

SUMMARY

In one embodiment, the facial lift device is constructed of flexible, high memory resin based material for effective outward force when forced in an inward manner. The facial lift device can be shaped to fit under and within a mandible or maxillary lip. In the preferred embodiment of the facial lift device the user will place the lift under the lip to push or contour the lips outward.

In another embodiment, the facial lift device is designed to provide non-invasive facial enhancement and is constructed to lift from within the vestibule under an upper of lower human lip. In various embodiments, the facial lift can be formed from either elastomeric material, acrylic resins, flexible plastics or silicone compounds.

In a still further embodiment, the prosthetic includes a front side and back side of identical nature, shape and contour. In such an embodiment, both top and bottom longitudinal edges of said appliance have an indentation in a region adapted to contact or lie near the frenulum.

In a still further embodiment, the appliance contains a metallic skeleton to enhance the product memory and related lift and add shaping stability.

A still further embodiment of the facial lift device is the outward force created by bending the device to fit within the human mouth, above the upper gum line or below the lower gum line. This embodied force pushes the outer facial tissue tightening the surface thereby removing and reducing aging lines and wrinkles while restricting the facial muscle.

An even further embodiment of the facial lift device is an aqueous based treatment applied to either or both sides of the device to be absorbed by the mucus membranes within the mouth for the purpose of skin nutrition and collagen growth. This treatment lo will be dissolved and absorbed locally as the device is placed within the moist oral cavity environment.

BRIEF DESCRIPTION OF THE DRAWINGS

The foregoing summary, as well as the following detailed description of the preferred embodiments, is better understood when read in conjunction with the appended drawings. For the purpose of illustrating the invention, there are shown in the drawings embodiments that are presently preferred, it being understood, however, that the invention is not limited to the specific apparatus, system, and instrumentalities disclosed. In the drawings.

DETAILED DESCRIPTION OF ILLUSTRATIVE EMBODIMENTS

This invention relates to a facial lift device for the mouth. The facial lift device is useful to provide non-invasive enhancement of upper and/or lower lip contour for cosmetic purposes including the reduction or elimination of facial wrinkles and aging lines in the area by restricting muscle movement. The facial lift of the present invention, which functions by forcing the lips and cheeks in an outward direction lifting out lines and wrinkles within the dermas, is constructed so that it can be fit within the mouth of any user with little or no difficulty. The facial lift consists of one flexible strip with two lifting locations, right and left of the center or frenulum area. This strip rests on both sides of the frenulum.

The facial lift can be made from inert elastomers, resins and/or silicone compounds, resistant to chemical and mechanical influences in the mouth. The facial lift can also be constructed from acrylic resin and/or flexible plastics, resistant to chemical and mechanical influences in the mouth.

Figure 1A:
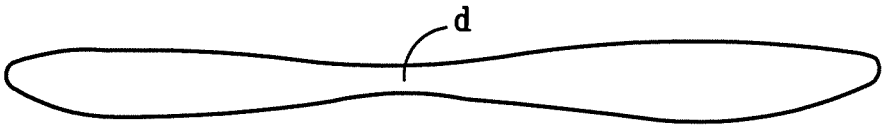
FIG. 1A is a frontal view of the inventions.
Figure 1B:
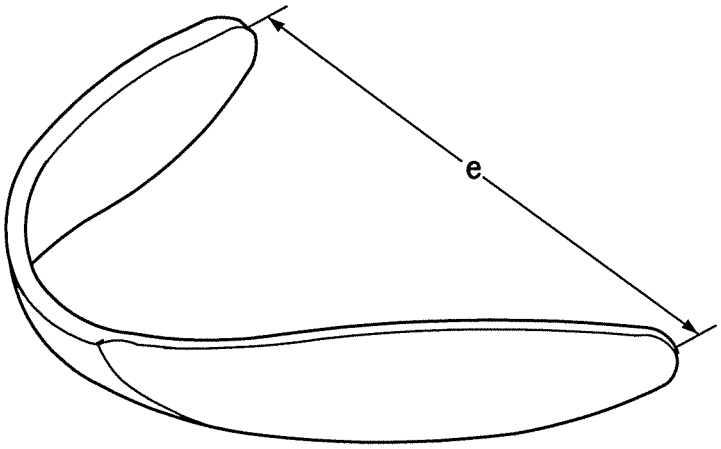
FIG. 1B is a perspective view of the front/top of the invention while flexed for positioning.
Figure 1C:
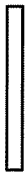
FIG. 1C is a side view of the device.

FIG. 1 shows the facial lift device in both resting and flexed positions. FIG. 1 (*a*) shows the device front or back (as they are reversible) in a flat, straight relaxed position illustrating the narrow middle or indentation (d) for proper clearance of the frenulum. FIG. 1 (*b*) depicts the facial lift device held in a flexed position as it would be prior to insertion into the mouth using (e) as an imaginary holding device by which to restrain the device from returning to its resting position FIG. 1 (*a*). FIG. 1 (*c*) depicts the facial lifting device from the side while in its resting position.

Figure 2:
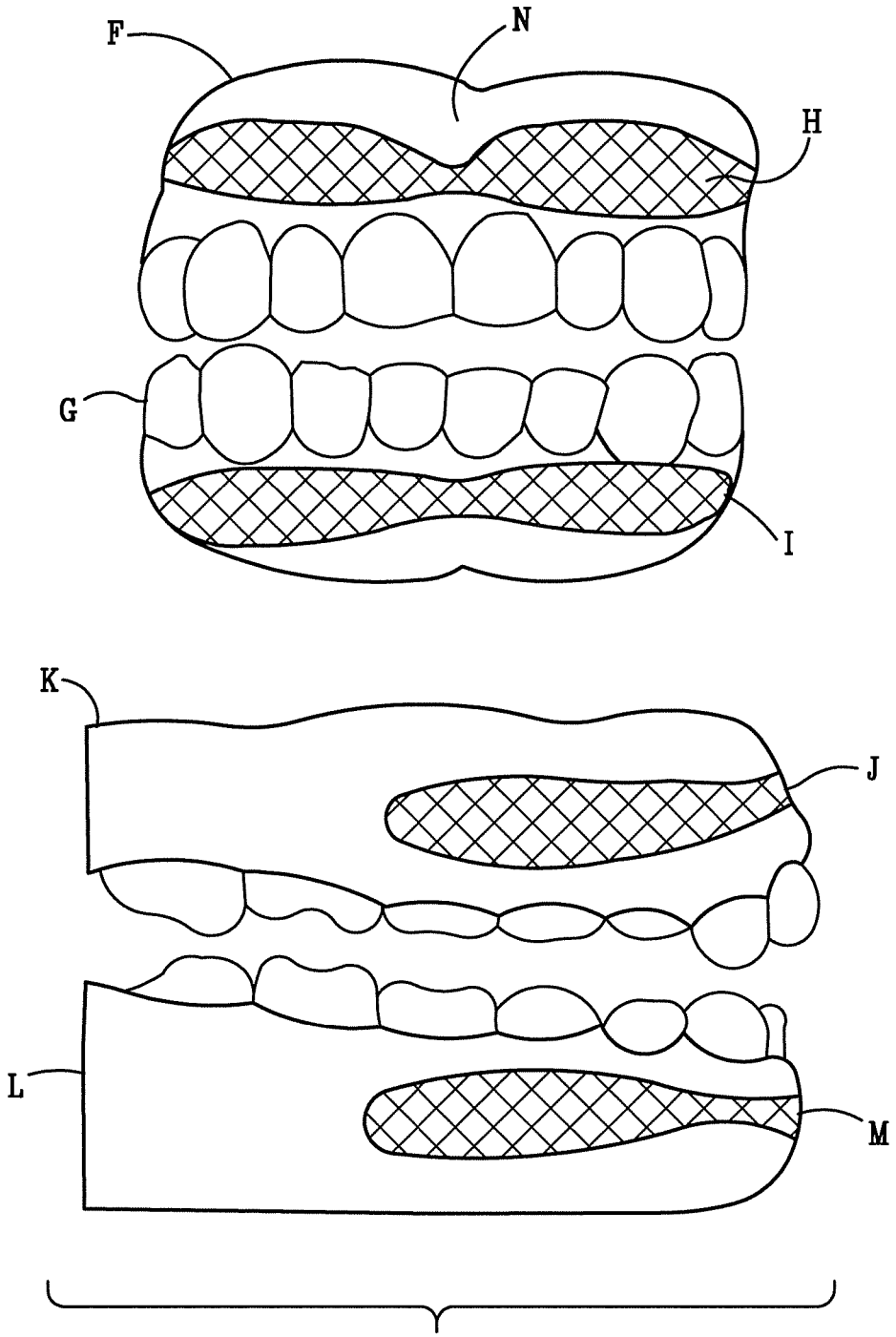
FIG. 2 is a front and side view of the device while placed on a human maxillary and mandible.

FIG. 2 demonstrates where the facial lift device is used in relation to the human maxillary and mandibular gums and teeth from the front and side views. FIG. 2 (*f*) depicts a human maxillary gum and tooth structure showing the frontal view of the device (h) as formed around the gum tissue by pressure from the covering lip, not shown. The facial device (h) will contour to the gum tissue after being placed under the lip (not shown). The facial device is manufactured to be flexible enough to easily fit under the human lips yet maintain enough memory to forcibly lift the lip tissue out away from the gums. FIG. 2(*n*) depicts the location of the human maxillary frenulum and corresponding depression on the subject device (h). Below this figure is the human mandible tooth and gum structure (g) depicting the device (i) as it would fit around the gum tissue as the lip tissue and muscle (not shown) pressure it against the gums. FIG. 2 (*k*) depicts the right side view of the human maxillary tooth, gum and jaw structure with the device (j) depicted as if to be forced in shape by the human lip and cheek (not shown). FIG. 2 (*l*) depicts the human mandibular tooth, gum and jaw structure with the device (m) depicted as if to be forced in shape by the human lip and cheek (not shown).

Figure 3A:
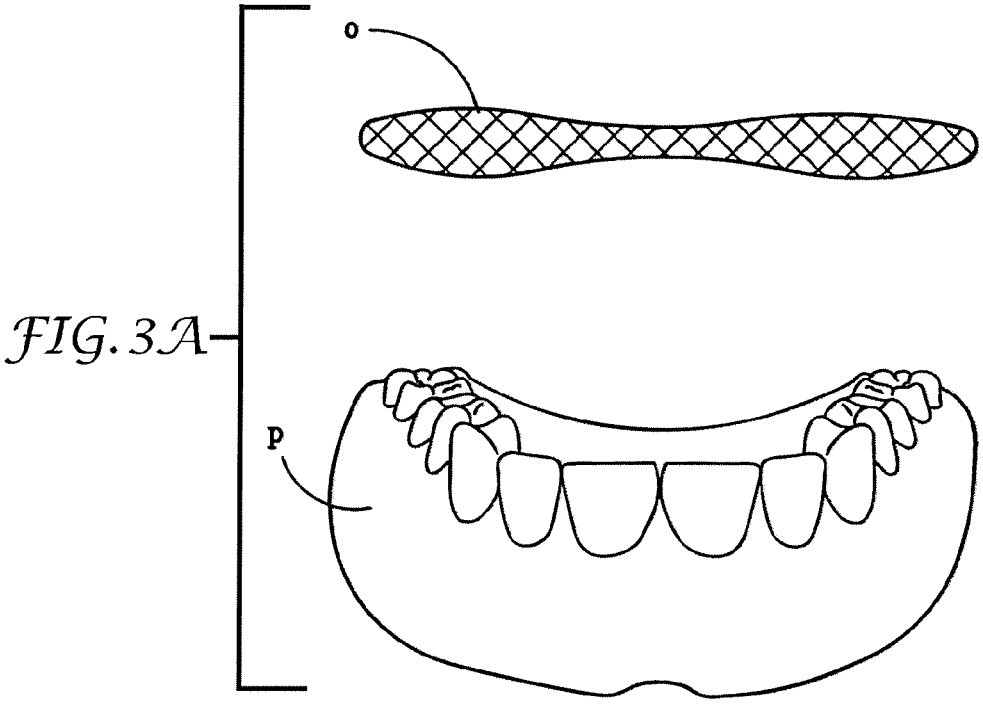
FIG. 3A is a frontal view of the device before placement on the maxillary anterior.
Figure 3B:
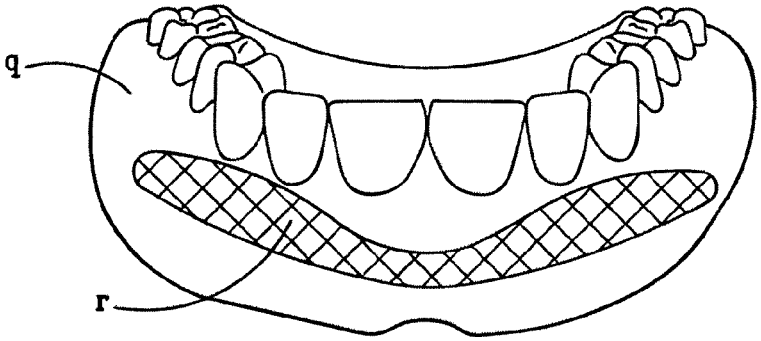
FIG. 3B is an inverted perspective view of the maxillary gum and teeth after receiving the facial lift device.

FIG. 3 (*o*) depicts the front/back of the reversible facial lift device before placing on FIG. 3 (*p*) an inverted view of a human maxillary tooth and gum structure. FIG. 3 (*q*) illustrates a perspective view of the inverted maxillary with the facial lift (r) in place as held by the lip (not shown). FIGS. 3 (*o*) and (*r*) demonstrates the device before and after insertion into the mouth (q). FIG. 3 (*r*) depicts the curvature which occurs as the facial lift device is placed under the lip.

Figure 4:
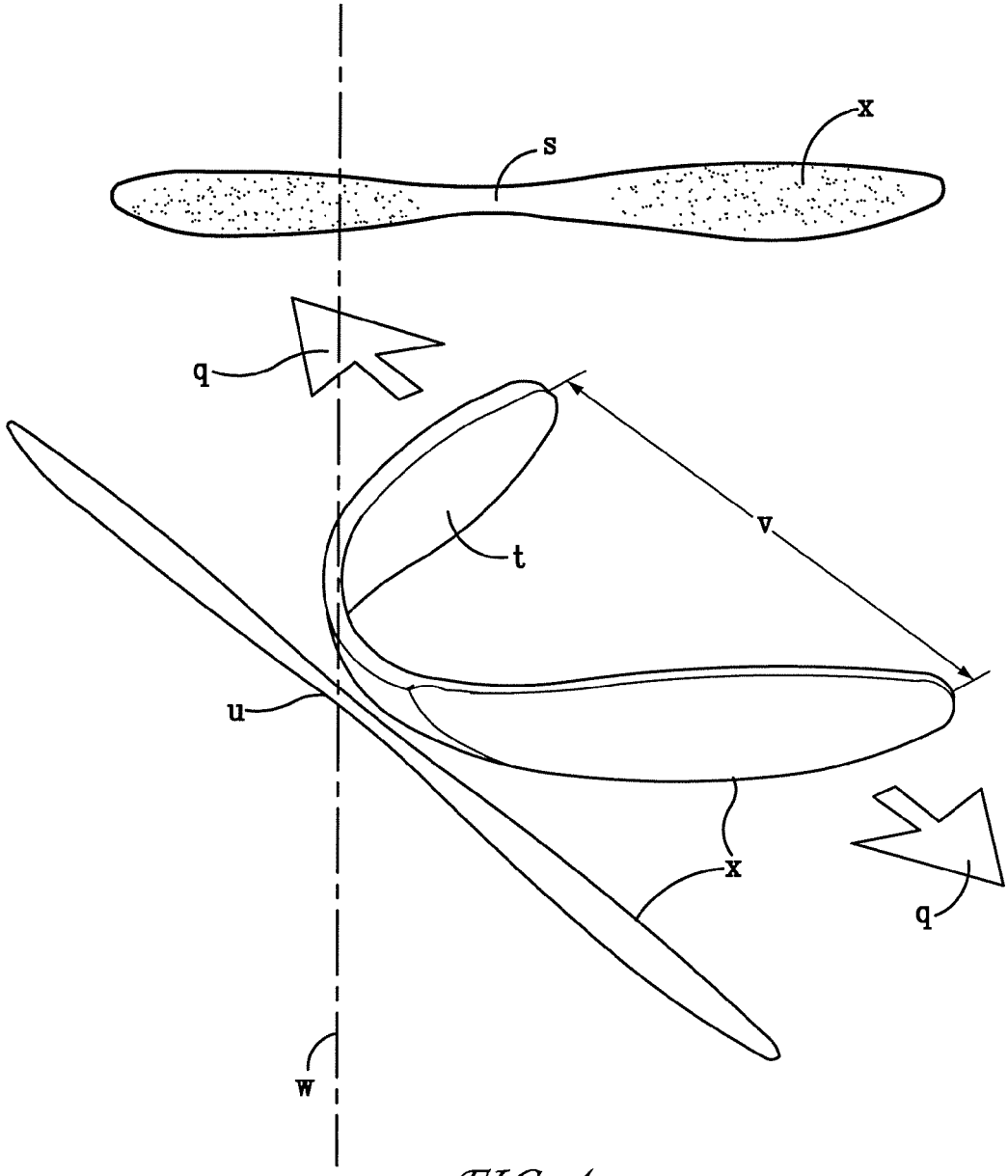
FIG. 4 is a frontal, top and perspective view of the invention while restrained in the flexed positioned demonstrating the outward force upon releases.

FIG. 4 depicts the device prior to insertion (s) and (u) and how the device will be shaped (t) as it is place under either of the maxillary or mandibular lips. As illustrated, the facial device (t) is held in the insertion shape by an imaginary clamp (v) in order to depict the direction of the outward, lifting forces (q) the created by device while under pressure or in use. The facial device is also depicted as (u) and in its resting position along the same vertical axes (w) as when under pressure (t). The vertical axes (w) depicts the pivot point of the device therefore eliminating any lift or force along the maxillary or mandible frenulum. As demonstrated within FIG. 4 all forces or lift generated by the insertion of the device stem from the right and left sides in an outward motion. This motion or resistance as demonstrated by (q) holds the device in place and lifts the dermas in an outward direction away from the body. FIG. 4 also depicts areas of the aqueous based skin treatment (x) to be applied to the facial device for absorption into the mucus membranes within the mouth, along the inside of the lip and cheek area.

The facial lift device of the present invention overcomes in simple manner evasive techniques of surgical implants placed into the lip areas and under the nose to reduce wrinkles and ageing lines. In one embodiment of the invention, elastomers or resins are used for construction of the appliance. In spite of their high shore hardness, these elastomers are soft, highly elastic, inert, i.e. resistant to chemical and mechanical lo influences in the mouth, and physiologically harmless. As they are transparent and almost invisible on the gums and preferably are colored in any known manner to match the respective gums.

The appliance may be removed from the mouth and cleaned effectively at any time desired. The appliance may be worn during eating or sleeping. An essential advantage of the appliance according to the invention must also be seen in the fact that it is inexpensive to prepare and does not require manipulations on healthy teeth for fitting or holding.

Again, the facial lift device of the invention is safely held in place by the use of material memory and outward resistance.

The facial lift device of the invention differs from prior inventions relating to dentures or similar as the current invention does not cover the top of the gums. The current invention does not cover, protect, maintain or house teeth, prosthetic teeth or similar.

The facial lift device of the invention differs from prior inventions relating to orthodontics as the invention does not alter of affect the occlusion of the teeth. The current invention does not alter, adjust or touch the teeth other than the clasping device which hold the appliance in place.

A still further embodiment of the facial lift device is safely held in place by a clamping device molded onto the prosthesis which temporarily attaches to the molars.

The facial lift device of the invention differs from prior inventions relating to gum atrophy or paradentosis as the facial lift device can be made from similar materials, however the purpose and/or function of the current invention is not to protect, cover or fit to exposed areas of the teeth beneath, above or below the gum line. The primary function of the device is to fill the cavity within the mouth between the gums and the lips to dissipate facial wrinkles.

In one embodiment of the invention, the prosthesis includes a front side having a surface structure and color that simulates the natural gums and a reverse side adapted to be mounted on the gums, one longitudinal edge of said appliance having an indentation in a region adapted to contact or lie near the frenulum, the opposite longitudinal edge of said appliance being short of the tooth necks.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Having the benefit of the teachings of this specification, others may affect numerous modifications thereto and changes may be made without departing from the scope and spirit of the invention in its aspects.

What is claimed:

1. A facial lift device to be placed behind the lips and above the gums of a mouth comprising: a body formed from a flexible strip consisting of a single material, having first and second lifting locations, having an elongated hourglass shape and having material memory, wherein said strip is generally flat when in a first resting position and, wherein said strip embodies an outward lifting force at said first and second lifting locations when bent into a second flexed position for placement behind the lips and above the gums, such that when said strip is in said second flexed position and placed behind at least one lip, the lifting force generated at said first and second lifting locations will lift a cheek and lip area resulting in dermal tension applied along a perioral facial surface, wherein said strip exhibits a tendency to return from said second flexed position to said first resting position.

2. The facial lift device as set forth in claim 1, wherein said facial lift device further comprises a duplicate interior and exterior surface.

3. The facial lift device, according to claim 1, wherein the facial lift device has a radial edge on both right and left ends.

4. The facial lift device, according to claim 1, wherein the facial lift device has a longitudinal edge indentation on both the top and bottom to allow for the frenulum.

5. The facial lift device, according to claim 1, wherein the facial lift device is constructed of one homogenous resin-based material.

6. The facial lift device, according to claim 1 wherein the said facial lift device is formed from elastomeric material.

7. The facial lift device, according to claim 1 wherein the said facial lift device embodies an aqueous-based dermal treatment.

8. The facial lift device, according to claim 1 wherein the said facial lift device is formed from flexible plastics.

9. The facial lift device, according to claim 1 wherein the said facial lift device is formed from silicone compounds.

10. A facial lift device, according to claim 1 wherein the said facial lift device embodies an aqueous-based dermal treatment by which to be absorbed within the mucus membranes on the posterior-most side of the mandible or maximal lips.

11. A facial lift strip, configured for placement behind the lips and above the gums of a mouth, comprising a flexible, flat strip consisting of a single resin-based material having a generally hourglass shape with a narrow center and two flared sides defining first and second lifting locations, wherein said material has memory whereby an outward lifting force is created when said strip is bent from a first resting position to a second bent position; whereby the strip produces outward lift at said first and second lifting locations after being bent into said second bent position and inserted into the mouth.

12. The facial lift device as set forth in claim 11, wherein said facial lift device is constructed of materials to maintain shape memory whereby an outward force is created once forcibly fit under the maxilla or mandible lip.

13. The facial lift device, according to claim 11, wherein the facial lift device has a longitudinal edge indentation on both the top and bottom to allow for the frenulum.

14. The facial lift device, according to claim 11, wherein the facial lift device is constructed of one homogenous resin-based material.

15. The facial lift device, according to claim 11 wherein the said facial lift device is formed from elastomeric material.

16. The facial lift device, according to claim 11 wherein the said facial lift device embodies an aqueous-based dermal treatment by which to be absorbed within the mucus membranes on the posterior-most side of the mandible or maximal lips.

17. The facial lift device, according to claim 11 wherein the said facial lift device embodies an aqueous-based vitamin compound coating by which to be absorbed within the mucus membranes on the posterior-most side of the mandible or maximal lips.

* * * * *